US005666129A

United States Patent [19]

Wurster et al.

[11] Patent Number: 5,666,129

[45] Date of Patent: Sep. 9, 1997

[54] ELECTRICAL DISPLAY ELEMENTS FOR DISPLAYING MULTIPLE DIFFERENT CONDITIONS

[75] Inventors: Stefan Wurster, Livermore; Haim Shafir, Sacramento; Ralph Andersson, Grass Valley, all of Calif.

[73] Assignee: Level One Communications, Inc., Sacramento, Calif.

[21] Appl. No.: 271,111

[22] Filed: Jul. 6, 1994

[51] Int. Cl.[6] ..... G08B 5/38

[52] U.S. Cl. ..... 345/83

[58] Field of Search ..... 345/83, 30, 31, 345/32, 204; 395/575

[56] References Cited

U.S. PATENT DOCUMENTS

| | | | |
|---|---|---|---|
| 4,812,744 | 3/1989 | Havel . | |
| 4,969,063 | 11/1990 | Scott et al. . | |
| 5,428,769 | 6/1995 | Glaser et al. | 395/575 |

OTHER PUBLICATIONS

AT&T Microelectronics, *T7202 Smart Hub Controller (SHC)*, Preliminary Data Sheet, Sep. 1992, 124 pp.

AT&T *T7201 Multi-Port Repeater Unit (MPR2)*, Preliminary Data Sheet, Jun. 1990, pp. 25–29.

"Am79C987 Hardware Implemented Management Information Base™," Advanced Micro Devices, Inc., publication #17305, Rev. A, Amendment/0, Feb. 1993, 29 pp.

"Am79C981 Integrated Multiport Repeater Plus" (IMR™), Advanced Micro Devices, Inc., publication #17306, Rev. A, Amendment/0, Feb. 1993, 41 pp.

"Local Area Networks Databook Ethernet and Token Ring," National Semiconductor Corporation, 1993, pp. #i to 3–142.

"MM54HC125/MM74HC125, MM54HC126/MM74HC126, Tri-State® Quad Buffers," Logic Databook, vol. 1, National Semiconductor Corporation, 1984, pp. 3–93 to 3–95.

"MM54HC240/MM74HC240, Inverting Octal Tri-State™ Buffer, MM54HC241/MM74HC241 Octal Tri-State Buffer," Logic Databook, vol. 1, National Semiconductor Corporation, pp. 3–201 to 3–205.

"MM54HC244/MM74HC244, Octal Tri-State® Buffer," Logic Databook, vol. 1, National Semiconductor Corporation, 1984, pp. 3–210 to 3–213.

"MM54HC365/MM74HC365 Hex Tri-State® Buffer, MM54HC366/MM74–HC366/MM74HC366 Inverting Hex Tri-State Buffer, MM54HC367/MM74HC367 Hex Tri-State Buffer, MM54Nc368/MM74HC368 Inverting Hex Tri-State Buffer," Logic Databook, vol. 1, National Semiconductor Corporation, 1984, pp. 3–263 to 3–269.

"MM54HC540/MM74HC540, Inverting Octal Tri-State® Buffer, MM54HC541/MM74HC541, Octal Tri-State Buffer," Logic Databook, vol. 1, National Semiconductor Corporation, 1984, pp. 3–295 to 3–297.

"MM54HC4511/MM74HC4511 BCD-to-7 Segment Latch/Decoder/Driver," Logic Databook, vol. 1, National Semiconductor Corporation, 1984, pp. 3–413 to 3–417.

*Primary Examiner*—Mark R. Powell

*Attorney, Agent, or Firm*—Merchant, Gould, Smith, Edell, Welter & Schmidt, P.A.

[57] ABSTRACT

A pair of electrical display elements, LEDs, is driven by a three-state buffer driver circuit. The LEDs have associated current-limiting resistors. The driver circuit applies different selected voltage levels at different selected predetermined frequencies to the LEDs. By having two predetermined frequencies to a pair of LEDs, there can be exhibited at least five different display conditions from the pair of LEDs.

36 Claims, 4 Drawing Sheets

| CONDITION | LEDTP 1-4 | LEDAUI | LEDCE | LEDJM |
|---|---|---|---|---|
| 1 | Rx LINK PULSE | Rx JABBER | FIFO ERROR | MANCHESTER CODE VIOLATION |
| 2 | Tx PACKET | Tx PACKET | N/A | N/A |
| 3 | REVERSED POLARITY | Rx COLLISION | COLLISION | NAU JABBER LOCKUP PROTECTION (MJLP) |
| 4 | Rx PACKET | Rx PACKET | N/A | N/A |
| 5 | PARTITIONED OUT | PARTITIONED OUT | N/A | N/A |

FIG. 5

ELECTRICAL DISPLAY ELEMENTS FOR DISPLAYING MULTIPLE DIFFERENT CONDITIONS

RELATED APPLICATION

This application is related to application Ser. No. 380,651 filed Jan. 30, 1995 now U.S. Pat. No. 5,574,726. The contents of that application are incorporated by reference herein.

BACKGROUND

Having electrical display elements associated with an electronic circuit and connected with a minimum number of external components to provide a high degree of different display conditions is valuable.

This invention relates to display elements for association with an electronic circuit. In particular, it relates to external display elements for association with a chip so that multiple electrical conditions as existent or indicated by the chip can be displayed with a minimum number of display elements. The invention is directed to yielding a high degree of information from each display.

The invention is directed more particularly to driving the display elements, which are preferably LEDs, without the need for external latches, decoders or buffers.

Prior known systems do not have a means for directly driving a display. Accordingly, the known techniques are relatively complex in decoding information from a device for display by a display element.

In one known prior art system, an IMR+ chip (Trademark of AMD) obtains status information from the device by stripping off a serial bit stream. This is decoded and latched to a display device.

In two other known chips, namely the MPR II and SHC chips (Trademarks of AT&T), the user is provided with seven data lines that encode 96 states. This requires the user to use external logic to decode the information on the lines. A state machine diagram is necessary to extract this information onto a visual display.

Other known devices, namely RIC and LERIC chips (Trademarks of NSC), provide a user with eight data lines that encode 60 states. The user needs to apply external logic to decode and latch this information.

All of these devices are unduly complex in their systems and circuitry for obtaining information from the display devices.

SUMMARY

The present invention is directed minimizing the disadvantages with known systems for driving external display elements.

According to the invention a circuit for operating a pair of electrical display elements includes a driver circuit having a buffer with three different output states for the pair of display elements, such as LEDs.

Means is provided for applying from the driver circuit to the pair of display elements two different selected voltage levels and a third state in which current from the LEDs is neither sourced nor sunk in the driver. The voltage at the drivers output in this state is determined by the external components (LEDs and resistors) to which it is connected. This will be referred to as the high impedance level. References to mid-voltage level refers to the voltage at the drivers output when the driver is in the high impedance state.

The voltage is at least two predetermined frequencies. The pair of electrical display elements is collectively operable to exhibit at least five different display conditions when so driven.

The display elements are preferably a pair of LEDs which are oppositely poled. The one LED emits a first color and the second LED emits a second color.

In a further preferred form of the invention, there are multiple LED pairs, each LED pair being driven by a respective one of multiple LED drivers. The LED drivers' are selectively part of an integrated repeater CMOS device. There are current-limiting resistors with each pair of LEDs, and the resistors and LEDs are external to the device.

The driver circuit can apply an oscillating voltage between a high-voltage level and a mid-voltage level at a first high frequency, thereby to provide a steady display to one LED. The oscillating voltage between the high-voltage and mid-voltage-levels at a high frequency gated on and off by a second lower frequency can be provided thereby to provide a blinking display to the same device. This provides a second display condition.

By applying an oscillating voltage between a mid-voltage and a low, preferably zero, voltage to a second display over two frequencies, a high frequency and a low frequency, a third and fourth display condition can be provided by the second display element. Such third condition would be a steady display, and such fourth condition a blinking display. By applying a low-frequency oscillation between the high voltage and low voltage to both the displays, the first display and second display can blink alternately and thereby provide a fifth display condition.

The invention is also directed to operating a pair of electrical elements with a driver circuit to generate three different selected voltage levels. The output can exhibit different electrical digital data conditions.

The invention is described with further reference to the accompanying drawings.

In addition, condition one or two can coexist with condition three or four and vice versa. However, condition one cannot coexist with condition two and condition three cannot exist concurrently with condition four.

DRAWINGS

FIG. 5 is an LED display truth table for an integrated LED driver system operable with the repeater chip of FIG. 4.

DESCRIPTION

Figure 1:
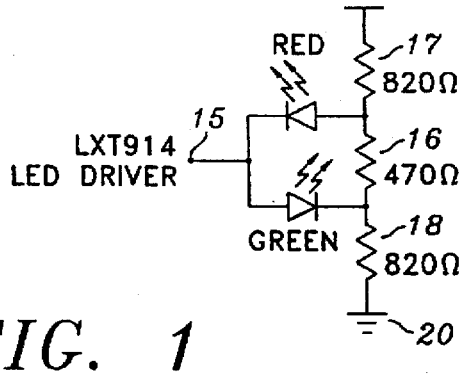
FIG. 1 is a schematic illustrating a pair of LEDs with two current-limiting resistors and one used for biasing.

A circuit for operating a pair of electrical display elements, namely LEDs 10 and 11 comprises an LED driver 12 within an LED driver section 13 of a chip 14. The LED driver 12 is connected through terminal 15 to the display devices 10 and 11. LED device 10 emits a red color and LED 11 emits a green color. The LEDs 10 and 11 which are the illustrated display elements are oppositely poled.

The driver circuit 12 formed in the chip for each of the pair of display elements 10 and 11 which are external to the chip is a three-state buffer circuit, namely a tri-state buffer. A typical external tri-state buffer device would be a Tri-State buffer. (Trademark of National Semiconductor).

The LEDs 10 and 11 are connected with three current-limiting resistors 16 and 18 in series with resistor 17 used for biasing LEDs 10 and 11. As indicated in FIG. 1, resistor 16 would have a resistance of 820 ohms, resistor 17 would have a resistance of 470 ohms and resistor 18 would have a resistance of 820 ohms. Resistor 16 is connected to a high-voltage level of 5 volts through line 19 and resistor 18 is connected to a low-voltage level, namely ground 20. The LED driver 12 can apply a mid-voltage to terminal 15 in a manner more fully described below.

Figure 2:
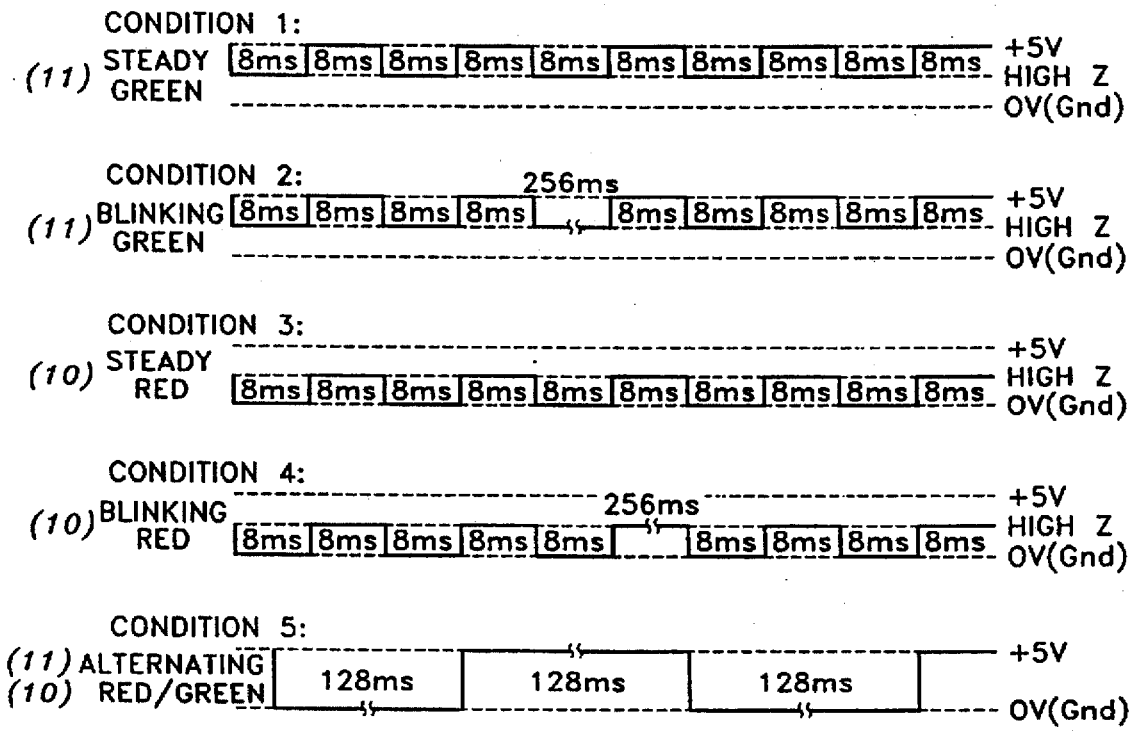
FIG. 2 is a timing diagram illustrating the five display conditions obtained from the display elements of FIG. 1.
Figure 3:
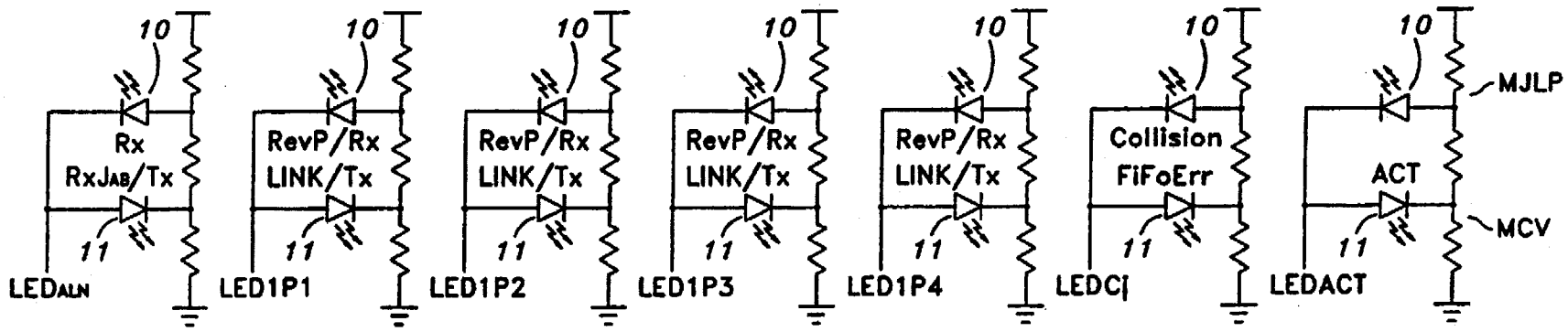
FIG. 3 is a representation of seven pairs of display devices.

The operation of each of the display elements is set out with relation to FIG. 2. The LED driver 12 has the ability to provide an oscillating voltage to the terminal 15. Such voltage can vary between a low level of 0 volts (ground), a mid-level voltage illustrated in FIG. 2 known as the high-impedance condition Z. This voltage could be about 2.5 volts. A third voltage level is the high-voltage level represented as +5 volts.

In one arrangement, the display device 11 is illustrated under condition 1. The voltage applied to the terminal 15 oscillates between the mid-voltage level and high-voltage level at a high frequency wherein the period for each half cycle is 8 milliseconds. Thus, the voltage at terminal 15 oscillates between the mid-voltage and high voltage every 8 milliseconds. This effectively retains the LED 11, emitting a green-colored signal under a steady condition. It is steady since the human eye is unable to detect any change in the emitting condition every 8 milliseconds.

Under the second condition for the LED 11, the period for which the voltage at terminal 15 is maintained at a mid-level is increased at selected times to 256 milliseconds. This long period of time, namely lower frequency, would indicate an "off" condition for the green diode 11. During the periods when the oscillations are every 8 milliseconds, the "on" condition would be reflected. Thus, the second condition is indicated to be a blinking condition, namely a second condition for the display device 11.

The display device 10, namely the red LED, operates under conditions where the voltage applied varies between the 0 voltage and mid-voltage. For the third condition, the voltage oscillates every 8 milliseconds and this will retain the red LED in a steady "on" condition, emitting red light.

The fourth condition is represented by changing the frequency of oscillation to a lower frequency, namely retaining the mid-voltage for 256 milliseconds. This would indicate that fourth condition. During the time that the high-frequency cycles are occurring between the 0 voltage and mid-voltage, this would represent an "on" condition.

The fifth condition is illustrated with reference to both display devices 10 and 11. In such a situation, the voltage at terminal 15 oscillates between the high voltage and the 0 voltage at a low frequency, namely 128 milliseconds. The voltage is high for 128 milliseconds and low for 128 milliseconds. This is a period of 256 milliseconds, namely a frequency–1/256 ms=4 HZ. In such a condition, the red and the green devices, 10 and 11, respectively will alternate on and "off". The fifth condition has a blink frequency twice that of conditions two and four. As conditions two and four can exist concurrently, this higher blink frequency distinguishes condition five from condition two and four occurring simultaneously. Since the period or cycle is sufficiently long, this will be discernable to the human eye which is capable of seeing changes taking place at this frequency.

In this manner the pair of display devices 10 and 11, having three voltages applied at two different preselected frequencies provide an arrangement of the display elements 10 and 11 with at least five conditions. In addition, condition one or two can coexist with condition three or four and vice versa. However, condition one cannot coexist with condition two and condition three cannot exist concurrently with condition four.

Figure 4:
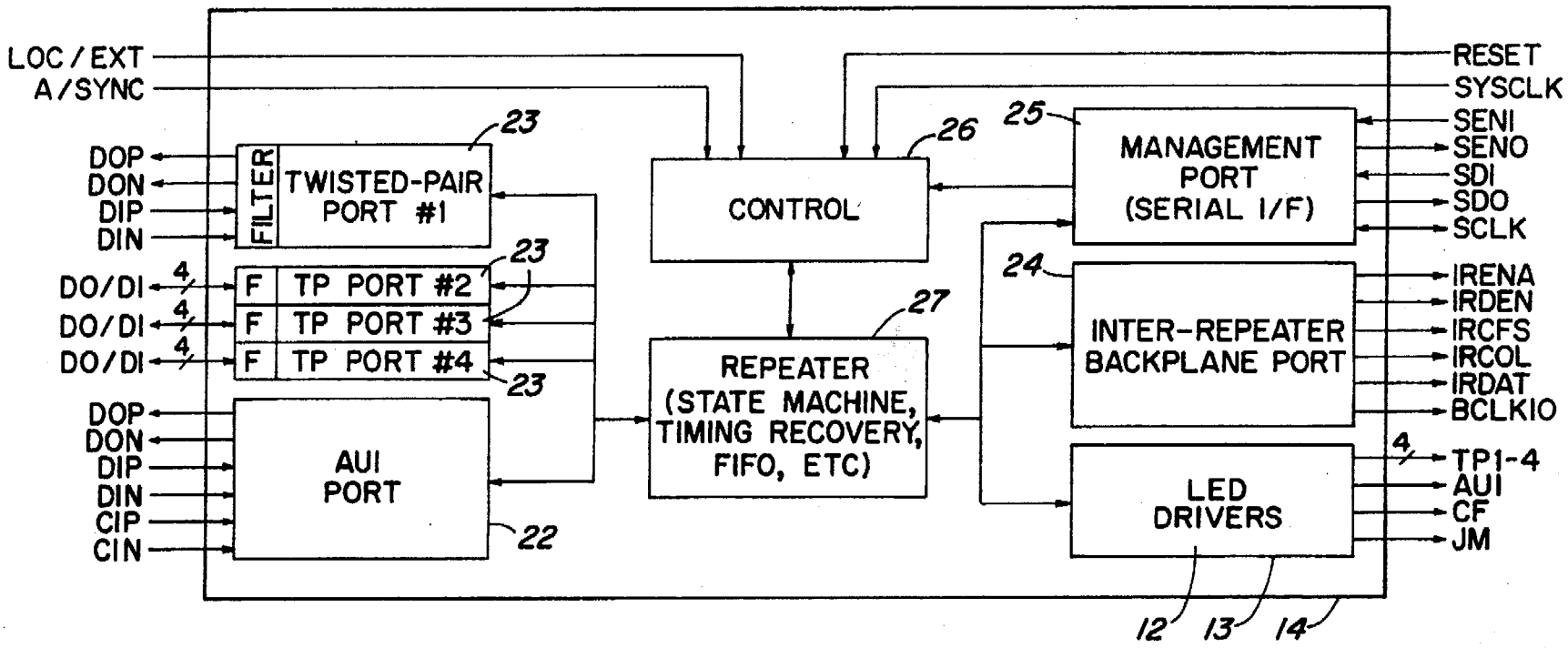
FIG. 4 is a block schematic of an integrated repeater having drivers for the display elements.

In a preferred arrangement, there are at least seven double LEDs 10 and 11 arranged with reference to the integrated circuit chip 14. This arrangement is illustrated in FIG. 2. In this manner at least 29 different conditions can be obtained from this arrangement of LED devices with the chip 14. The chip 14 is illustrated in detail in FIG. 4 and is an integrated multiport repeater designed for mixed media networks. Such a Chip is an LXT914 (Trademark of Level One of Sacramento, Calif. 95827). The chip provides all the active circuitry required for a repeater function in a single CMOS device. It includes an attachment unit interface (AUI) 22 and four 10-base T receivers 23. These are illustrated in FIG. 4. The AUI port allows for connection of an external transceiver or a drop cable. The transceivers 23 are self contained and require no external filters. There is an inter-repeater backplane interface 24 for allowing 128 or more 10-base T ports to be cascaded together. Additionally, there is a serial port 25 for providing information for network management and statistic gathering. The LEDs 12 are provided as an integrated unit connected to the LED driver section 13. There is a control portion 26 provided for the chip and a repeater 27 for the state machine, timing recovery and FIFO of the chip.

The relationship of the LED driver pin descriptions with regard to the LXT914 is set out in more detail as follows:

LED Driver Pin Descriptions

| Symbol | Name | Description |
|---|---|---|
| LEDCF | Collision & FIFO Error LED Driver | Reports collisions and FIFO errors. It pulses low to report collisions and pulses high to report FIFO errors. When this pin is connected to the anode of one LED and to the cathode of a second LED, the LXT914 simultaneously monitors and reports both conditions independently. |
| LEDJM | Jabber/MJLP & Manchester Code Violation LED Driver | Reports jabber and code violations. It pulses low to report MAU Jabber Lockup Protection (MJLP), and pulses high to report manchester code violations. When this pin is connected to the anode of one LED and to the cathode of a second LED, the LXT914 simultaneously monitors and reports both conditions independently. |
| LEDTP1 LEDTP2 LEDTP3 LEDTP4 | TP Port LED Drivers | An alternating pulsed output reports TP port status. Each pin should be tied to a pair of LEDs (to the anode of one LED and the cathode of a second LED). When connected this way, each pin reports five separate conditions (receive, transmit, link integrity, reverse polarity and auto partition). |
| LEDAUI | AUI Port LED Driver | An alternating pulsed output reports AUI port status. This pin should be tied to a pair of LEDs (to the anode of one LED and the cathode of a second LED). When connected this way, this pin |

-continued

| LED Driver Pin Descriptions | | |
|---|---|---|
| Symbol | Name | Description |
| | | reports five separate conditions (receive, transmit, receive jabber, receive collision and auto partition). |

The operational conditions of each of the pins is described. The first four pins are described as LEDTP1–4 and are set out in the first column of FIG. 5. The remaining three pins are described in relation to their operation and condition which is displayed by the display elements and lists the repeater states associated with each condition. For example, using red and green LEDs for the twisted pair ports 23, each TP port LED driver provides the following indications:

1. steady green wherein link integrity pulses are received;
2. blinking green when data is transmitted;
3. steady red when reverse polarity is detected;
4. blinking red when data is received; and
5. alternating red and green when the port is auto partitioned out.

Many other forms of the invention exist, each differing from others in matters of detail only. For instance, there could be situations where the display elements are not LEDs, but other suitable displays.

Optoisolators can be used to translate the display data to digital data for use on local or remote circuits. A transistor used in conjunction with an RC network can be used to filter out condition two and five or four and five, displaying only condition one or condition three. This circuit would supply either digital signals or drive LEDs.

The pair of display devices with the three-state buffer may be usable with other chips to provide different display conditions. The display system may also be independently operable with other electronic circuits.

In yet other forms of the invention where only three conditions need to be displayed, it is possible to use conditions 1, 2 and 5. In such a system, the three voltages will be applicable with the two different frequencies, as would be appropriate with conditions 1, 2 and 5. In a different situation, conditions 3, 4 and 5 can be applicable. In that situation, the appropriate voltages as illustrated in FIG. 2 with regard to conditions 3, 4 and 5 and the frequencies applicable under those conditions would be used.

The invention is directed to providing multiple displays with a minimum number of different display conditions relating to different input information.

The invention is to be determined solely in terms of the following claims.

What is claimed is:

1. A circuit for operating a pair of electrical display elements comprising:

a driver circuit having an output connected to the pair of display elements, and means for applying an oscillating signal from the output of the driver circuit to the pair of display elements, the oscillating signal oscillating between a selected two of three different voltage levels at a selected one of two predetermined frequencies wherein the pair of electrical display elements collectively are operable to exhibit at least five different display conditions.

2. A circuit as claimed in claim 1 wherein the driver circuit includes a tri-state buffer circuit.

3. A circuit as claimed in claim 1 including a current-limiting circuit connected with the display elements, such current-limiting circuit including only three elements.

4. A circuit as claimed in claim 1 wherein the display devices are LEDs and the driver circuit is a three-state buffer circuit including three resistors arranged as a current-limiting biasing circuit for the LEDs.

5. A circuit as claimed in claim 4 wherein the LEDs are oppositely poled relative to the three-state buffer, and wherein one LED emits a first color and a second LED emits a second color.

6. A circuit as claimed in claim 1 including multiple pairs of display elements thereby to exhibit multiple different display conditions.

7. A circuit as claimed in claim 6 wherein there are at least seven pairs of display elements.

8. A circuit as claimed in claim 1 wherein the driver circuit is formed as portion of a chip, the chip including components designated for other signal processing.

9. A circuit as claimed in claim 8 wherein the chip components include means for receiving and outputting signals and responding as a repeater circuit in a network system.

10. A circuit as claimed in claim 9 wherein the repeater components and driver are constituted as a single CMOS device.

11. A circuit as claimed in claim 1 including multiple driver circuits on a chip, each driver circuit being for operating directly a respective display pair.

12. A circuit as claimed in claim 11 including a repeater component and wherein the driver circuits are constituted as a single CMOS device.

13. A circuit as claimed in claim 1 including means for having the driver circuit apply an oscillating voltage between a high voltage and mid-voltage at a first high frequency thereby to provide a steady display condition, such condition being a first display condition, and a high voltage and a mid-voltage at a high frequency gated on and off at a second lower frequency thereby to provide a blinking display condition, thereby to provide a second display condition.

14. A circuit as claimed in claim 1 including means for having the driver circuit apply an oscillating voltage between a mid-voltage and a low voltage at a first high frequency thereby to provide a steady display condition, such condition being a third display condition, and to apply a mid-voltage and a low voltage at a high frequency gated on and off at a second lower frequency thereby to provide a blinking condition, such blinking condition being a fourth display condition.

15. A circuit as claimed in claim 13 including means for having the driver circuit apply an oscillating voltage between a mid-voltage and a low voltage at a first high frequency thereby to provide a steady display condition, such condition being a third display condition, and to apply a mid-voltage and a low voltage at a high frequency gated on and off at a second lower frequency thereby to provide a blinking condition, such blinking condition being a fourth display condition.

16. A circuit as claimed in claim 14 including applying the second lower frequency and not the first frequency thereby to provide a fifth display condition, such fifth display condition being the alternating display of the first display and the second display of the pair of display elements, and wherein the second frequency is applied between a voltage oscillating between the low voltage and the high voltage.

17. A circuit as claimed in claim 1 wherein the five different display conditions can be displayed selectively independently or in conjunction with each other.

18. A circuit as claimed in claim 17 where the first condition is displayed at the same time as the third or fourth condition.

19. A circuit as claimed in claim 17 where the second condition is displayed at the same time as the third or fourth condition.

20. A circuit as claimed in claim 17 where the third condition is displayed at the same time as the first or second condition.

21. A circuit as claimed in claim 17 where the fourth condition is displayed at the same time as the first or second condition.

22. A circuit as claimed in claim 15 including applying the second lower frequency and not the first frequency thereby to provide a fifth display condition, such fifth display condition being the alternating display of the first display and the second display of the pair of display elements, and wherein the second frequency is applied between a voltage oscillating between the low voltage and the high voltage.

23. A circuit for operating an electrical display element comprising:

a driver circuit having an output connected to the display element, and means for applying an oscillating signal from the output of the driver circuit to the display element, the oscillating signal oscillating between a selected two of three different voltage levels at a selected one of two predetermined frequencies wherein the electrical display element collectively is operable to exhibit at least three different display conditions.

24. A circuit as claimed in claim 23 including means for having the driver circuit apply at least three different voltage levels to the display element, and wherein the voltage levels are respectively high, intermediate and low, and wherein oscillation between an intermediate and high level, or between a low level and intermediate level at a first or second frequency generates a first and second display condition, and oscillation between a low level and a high level at a second frequency displays a third display condition.

25. A method of operating a pair of electrical display elements comprising driving the pair of display elements with an oscillating signal, the oscillating signal selected to oscillate between a selected two of three different voltage levels at a selected one of two predetermined frequencies, and having the pair of electrical display elements collectively exhibit at least five different display conditions.

26. As method as claimed in claim 25 including having display elements be LEDs oppositely poled relative to a three-state buffer, and wherein one LED emits a first color and a second LED emits a second color.

27. A method as claimed in claim 25 including applying an oscillating voltage between a high voltage and mid-voltage at a first high frequency thereby to provide a steady display condition, such condition being a first display condition, and a high voltage and a mid-voltage at a high frequency gated on and off by a second lower frequency thereby to provide a blinking display condition, thereby to provide a second display condition.

28. A method as claimed in claim 25 including applying an oscillating voltage between a mid-voltage and a low voltage at a first high frequency thereby to provide a steady display condition, such condition being a third display condition, and to apply a mid-voltage and a low voltage at a high frequency gated on and off by a second lower frequency thereby to provide a blinking condition, such blinking condition being a fourth display condition.

29. A method as claimed in claim 27 including applying an oscillating voltage between a mid-voltage and a low voltage at a first high frequency thereby to provide a steady display condition, such condition being a third display condition, and to apply a mid-voltage and a low voltage at a high frequency gated on and off by a second lower frequency thereby to provide a blinking condition, such blinking condition being a fourth display condition.

30. A method as claimed in claim 28 including applying the second lower frequency and not the first frequency thereby to provide a fifth display condition, such fifth display condition being the alternating display of the first display and the second display of the pair of display elements, and wherein the second frequency is applied between a voltage oscillating between the low voltage and the high voltage.

31. A method as claimed in claim 29 including applying the second lower frequency and not the first frequency thereby to provide a fifth display condition, such fifth display condition being the alternating display of the first display and the second display of the pair of display elements, and wherein the second frequency is applied between a voltage oscillating between the low voltage and the high voltage.

32. A method of operating an electrical display element comprising driving the display element with an oscillating signal, the oscillating signal selected to oscillate between a selected two of three different voltage levels at a selected one of two predetermined frequencies, and having the electrical display element exhibit at least three different display conditions.

33. A method as claimed in claim 32 including applying at least three different voltage levels to the display element, and wherein the voltage levels are respectively high, intermediate and low, and wherein oscillation between an intermediate and high level, or between a low level and intermediate level, at a first or second frequency generates a first and second display condition, and oscillation between a low level and a high level at a second frequency displays a third display condition.

34. A circuit for operating a pair of electrical elements comprising:

a driver circuit having an output connected to the pair of electrical elements, and means for applying an oscillating signal from the output of the driver circuit to the pair of electrical elements, the oscillating signal oscillating between a selected two of three different voltage levels at a selected one of two predetermined frequencies wherein the pair of electrical elements collectively are operable to exhibit at least five different electrical digital data conditions.

35. A circuit as claimed in claim 34 wherein the driver circuit includes a tri-state buffer circuit.

36. A circuit for operating an electrical element comprising:

a driver circuit having an output connected to the electrical element, and means for applying an oscillating signal from the output of the driver circuit to the electrical element, the oscillating signal oscillating between a selected two of three different voltage levels at a selected one of two predetermined frequencies wherein the electrical element collectively is operable to exhibit at least three different electrical digital data conditions.

* * * * *